US006776664B1

(12) United States Patent
Huang

(10) Patent No.: US 6,776,664 B1
(45) Date of Patent: Aug. 17, 2004

(54) ELECTRICAL CONNECTOR WITH RETENTION AND GUIDING MEANS

(75) Inventor: Chien-Hsun Huang, Tu-Chen (TW)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/454,908

(22) Filed: Jun. 4, 2003

(30) Foreign Application Priority Data

Apr. 9, 2003 (TW) ..... 92205558

(51) Int. Cl.[7] ..... H01R 17/00
(52) U.S. Cl. ..... 439/660
(58) Field of Search ..... 439/660, 495, 439/79, 924.1, 74, 563, 889, 848, 496

(56) References Cited

U.S. PATENT DOCUMENTS 5,695,359 A 12/1997 Fujikura et al.
5,741,154 A 4/1998 Fujikura et al.
5,882,212 A * 3/1999 McHugh et al. ..... 439/74
6,129,589 A * 10/2000 Simmel et al. ..... 439/660
6,319,068 B1 * 11/2001 Bao ..... 439/660
6,500,013 B1 * 12/2002 Wang ..... 439/108
6,540,561 B1 * 4/2003 Masumoto ..... 439/660
6,645,005 B2 * 11/2003 Wu ..... 439/563
6,699,049 B1 * 3/2004 Wu ..... 439/79

FOREIGN PATENT DOCUMENTS

JP 11-233212 8/1999
JP 2000-106235 4/2000

* cited by examiner

*Primary Examiner*—P. Austin Bradley
*Assistant Examiner*—Phuongchi Nguyen
(74) *Attorney, Agent, or Firm*—Wei Te Chung

(57) ABSTRACT

An electrical connector (1) includes a housing (10), and a plurality of terminals (12, 13) received in the housing. The housing defines side surfaces (1020, 1020') each forming a plurality of spacers (1022, 1022'). Two adjacent spacers and the corresponding side surface cooperatively define a terminal-passage (1021, 1026) for receiving a terminal therein. Each spacer is formed with at least one retention portion (1023) having a slanted guiding surface (1024) and a positioning surface (1025). The retention portions of each terminal-passage prevent the corresponding terminal from moving between the retention portions and the corresponding side surface. Moreover, two adjacent opposing guiding surfaces of the terminal-passage guide a mating contact of an associated electrical connector until the mating contact is received between two adjacent opposing positioning surfaces of the terminal-passage. Thus the mating contact is securely and reliably received in the terminal-passage.

2 Claims, 7 Drawing Sheets

ELECTRICAL CONNECTOR WITH RETENTION AND GUIDING MEANS

BACKGROUND OF THE INVENTION

1. Field of the Invention

The present invention relates to electrical connectors, and more particularly to an electrical connector for electrically interconnecting a complementary electrical connector with an electrical interface such as a flexible printed circuit (FPC) board.

2. Description of the Prior Art

With the trend toward miniaturization of electrical components, accurate orientation of the electrical components in an apparatus becomes increasingly problematic. The reliability of the apparatus depends in large part on the precision with which the electrical components are oriented therewithin.

FIG. 6 shows a typical FPC connector 6, which comprises a dielectric housing 60, a plurality of terminals 61 received in the housing 60, and a slider member 62 slidably inserted in the housing 60. A plurality of terminal-passages 600 is defined in the housing 60, the terminal-passages 600 receiving the corresponding terminals 61 therein. In use, an FPC board 5 is inserted in an opening 602 defined in the housing 60. The slider member 62 is then inserted in the opening 602, for enabling conductive pads of the FPC board 5 (not shown) to mate with corresponding engaging portions 610 of the terminals 61. A soldering portion 611 of each terminal 61 is soldered onto a printed circuit board (not shown). Thus electrical engagement between the printed circuit board and the FPC board 5 is attained.

Over time, the FPC board 5 may be repeatedly inserted into and removed from the housing 60. After a time, the slider member 62 and the housing 60 at the opening 602 are liable to become worn, with the slider member 62 only loosely engaging with the housing 60. Thus electrical engagement between the printed circuit board and the FPC board 5 is prone to be unreliable. If a new connector 6 is needed to replace the worn connector 6, the worn connector 6 must be unsoldered from the printed circuit board. Heat generated during the unsoldering process is liable to damage the printed circuit board and adjacent electrical components thereof. U.S. Pat. Nos. 5,695,359 and 5,741,154 disclose connectors having similar problems to those described above.

In order to overcome the above problems, Japan Patent Publication Numbers 2000-106235 and 11-233212 disclose an FPC adaptor connector. The adaptor connector electrically interconnects with a complementary connector and an FPC board. The complementary connector is soldered on a printed circuit board. The adaptor connector mates with the FPC board by the same means as described above. If a slider member of the adaptor connector is damaged, the entire adaptor connector is replaced by a new adaptor connector without removal of the complementary connector.

Referring to FIG. 7, an FPC adaptor connector 6' of the kind described above comprises a housing 60', a base 63' mounted on the housing 60', a plurality of terminals 61' received in the housing 60' and the base 63', a slider member 62' slidably inserted in the housing 60', and an actuator member 64' pivotally mounted on the housing 60'.

An island 65' is defined in a middle of the housing 60'. Two rows of terminal-passages 651' are defined in longitudinal opposite sides of the island 65'. Slots (not shown) are defined in the base 63', corresponding to the terminal-passages 651'. A plurality of spacer 652' is formed on the opposite sides of the island 65', each spacer 652' separating two adjacent terminal-passages 651'. Each terminal 61' has a first engaging portion (not shown) and a second engaging portion (not labeled). The first engaging portion is received in a corresponding slot, for engaging with a contact pad (not shown) on an FPC board. The second engaging portion is received in a corresponding terminal-passage 651', for engaging with a corresponding mating contact of a complementary electrical connector mounted on a printed circuit board (not shown). Electrical engagement between the printed circuit board and the FPC board is thus attained.

However, each spacer 652' is essentially a parallelepiped-shaped block, without means for preventing the corresponding second engaging portions of two adjacent terminals 61' from deflecting away from the corresponding side of the island 65'. Thus the second engaging portions of the terminals 61' are liable to be bent or displaced outwardly from the sides of the island 65'. If this happens, during insertion of mating contacts of the complementary electrical connector into the FPC adaptor connector 6', top ends of the second engaging portions are liable to interfere with bottom ends of the mating contacts. Both the terminals 61' and the contacts are liable to be damaged in this process.

Additionally, a distance between two adjacent spacers 652' is greater than a corresponding width of each second engaging portion, and greater than a width of an engaging portion (not shown) of each mating contact of the complementary electrical connector. If the mating contacts are themselves not precisely positioned in the complementary electrical connector, during said insertion of the mating contacts, engagement between the terminals 61' and the corresponding mating contacts is reliable to be misaligned. If this happens, secure electrical engagement may not be attained, and open circuits may be created. As a result, electrical connection between the adaptor connector 6' and the complementary connector is unreliable.

Accordingly, there is a need to provide an improved electrical connector to overcome the above-mentioned problems.

SUMMARY OF THE INVENTION

Accordingly, a main object of the present invention is to provide an electrical connector that securely locates terminals in a housing thereof.

Another object of the present invention is to provide an electrical connector able to securely and reliably receive mating contacts of a complementary electrical connector therein.

To fulfill the above-mentioned objects, an electrical connector of the present invention comprises a second housing, a first housing mounted on the second housing, a plurality of terminals received in the first and second housings, a slider member slidably inserted in the second housing, and an actuator member pivotally mounted on the first housing. An island is formed in the first housing. A plurality of spacers is formed on opposite side surfaces of the island respectively. Each two adjacent spacers and the corresponding side surface cooperatively define a terminal-passage. Each terminal has an engaging portion received in a corresponding terminal-passage. Two retention portions are formed on each spacer. Each retention portion is configured with a slanted guiding surface and a positioning surface.

With this structure, during insertion of the terminal into the corresponding terminal-passage of the first housing, the two opposing retention portions of the terminal-passage prevent the engaging portion of the terminal from moving between the retention portions and the corresponding side surface. Thus the terminal is securely located in the terminal-passage of the first housing. Moreover, the adjacent opposing guiding surfaces of the terminal-passage guide insertion of a mating contact of a complementary electrical connector until the mating contact is received between the two opposing positioning surfaces of the terminal-passage. Thus the mating contact is securely and reliably received in the terminal-passage.

Other objects, advantages and novel features of the present invention will become more apparent from the following detailed description when taken in conjunction with the accompanying drawings, in which:

DESCRIPTION OF PREFERRED EMBODIMENTS OF THE INVENTION

Reference will now be made to the drawings to describe the present invention in detail.

Figure 1:
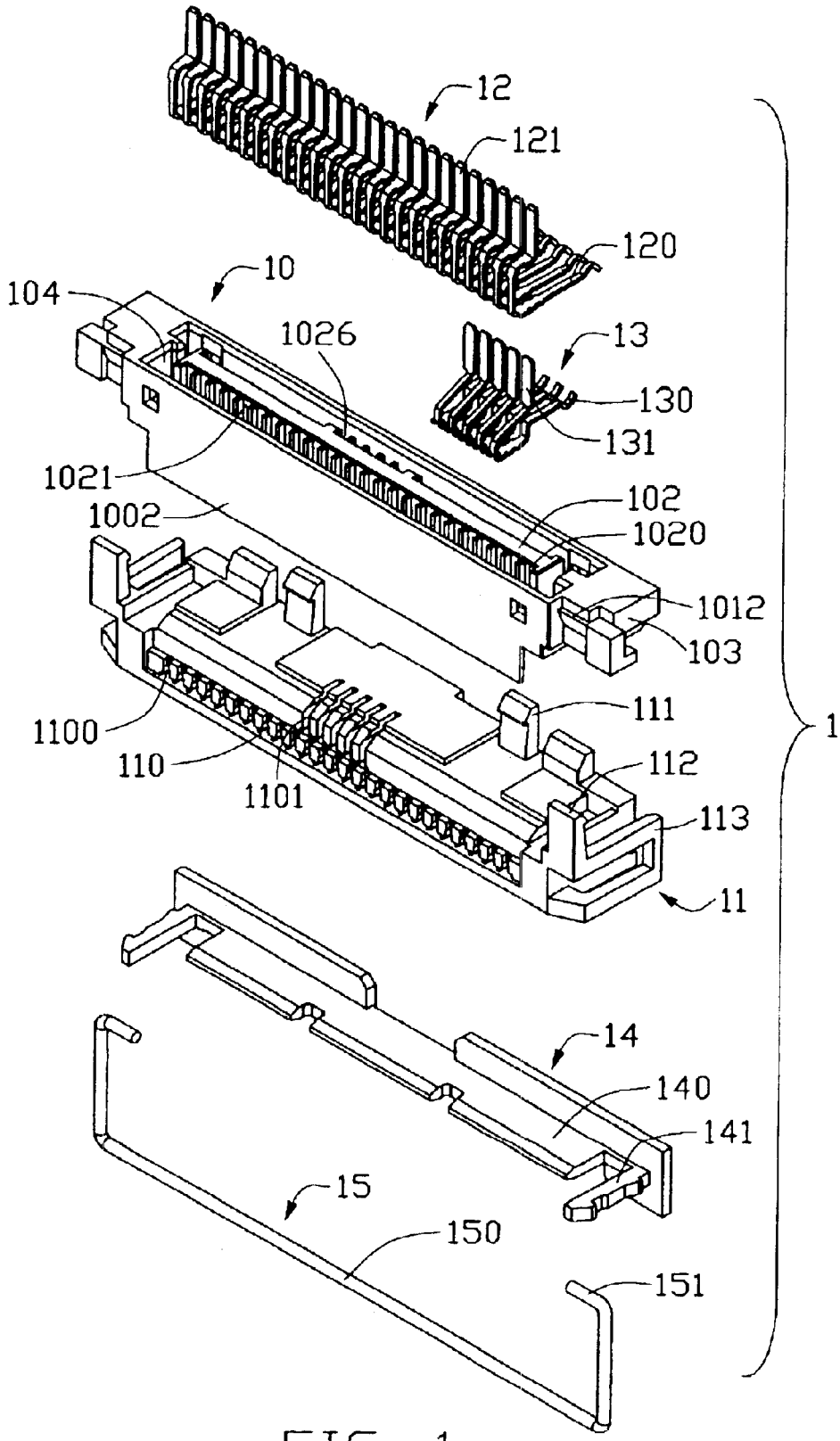
FIG. 1 is an exploded, isometric view of an electrical connector according to the present invention.

FIG. 1 shows an exploded, isometric view of an electrical connector 1 according to the present invention. The electrical connector 1 comprises an elongate dielectric second housing 11, an elongate dielectric first housing 10 mounted on the second housing 11, a plurality of first and second terminals 12, 13 received in the first and second housings 10, 11 respectively, a slider member 14 slidably inserted in the second housing 11, and an actuator member 15 pivotally mounted on the first housing 10.

Figure 2:
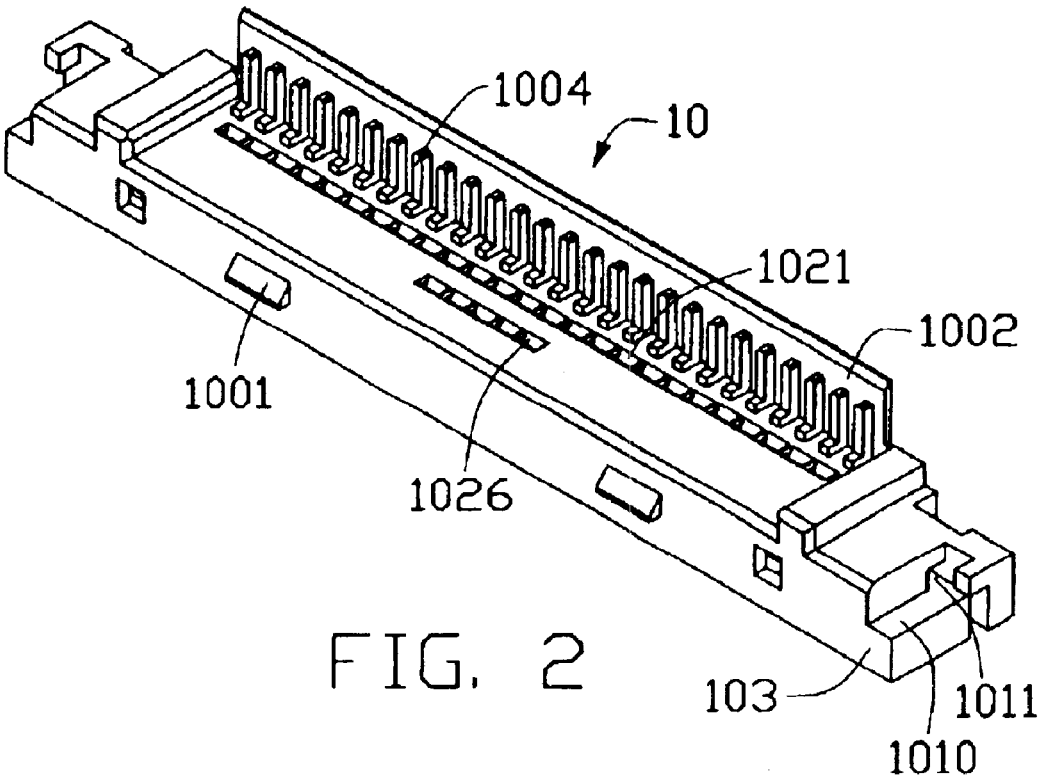
FIG. 2 is an isometric view of a first housing of the connector of FIG. 1, but showing the first housing inverted.

The first housing 10 comprises a pair of ear portions 103 at opposite ends thereof respectively. Each ear portion 103 is formed with a protrusion portion 1012 and an extending portion 1010. A pivot hole 1011 is defined in each ear portion 103. Referring also to FIG. 2, two spaced protrusion blocks 1001 are formed on one side of the first housing 10. A longitudinal side wall 1002 depends from a bottom of the first housing 10. A plurality of spaced partition blocks 1004 is formed on an inside of the side wall 1002 and an adjoining bottom surface of the first housing 10. Each two adjacent partition blocks 1004 cooperatively position a corresponding terminal 12 or 13 therebetween. An elongate first opening 104 is defined in a middle of the first housing 10. An island 102 is formed in the first opening 104.

Figure 3:
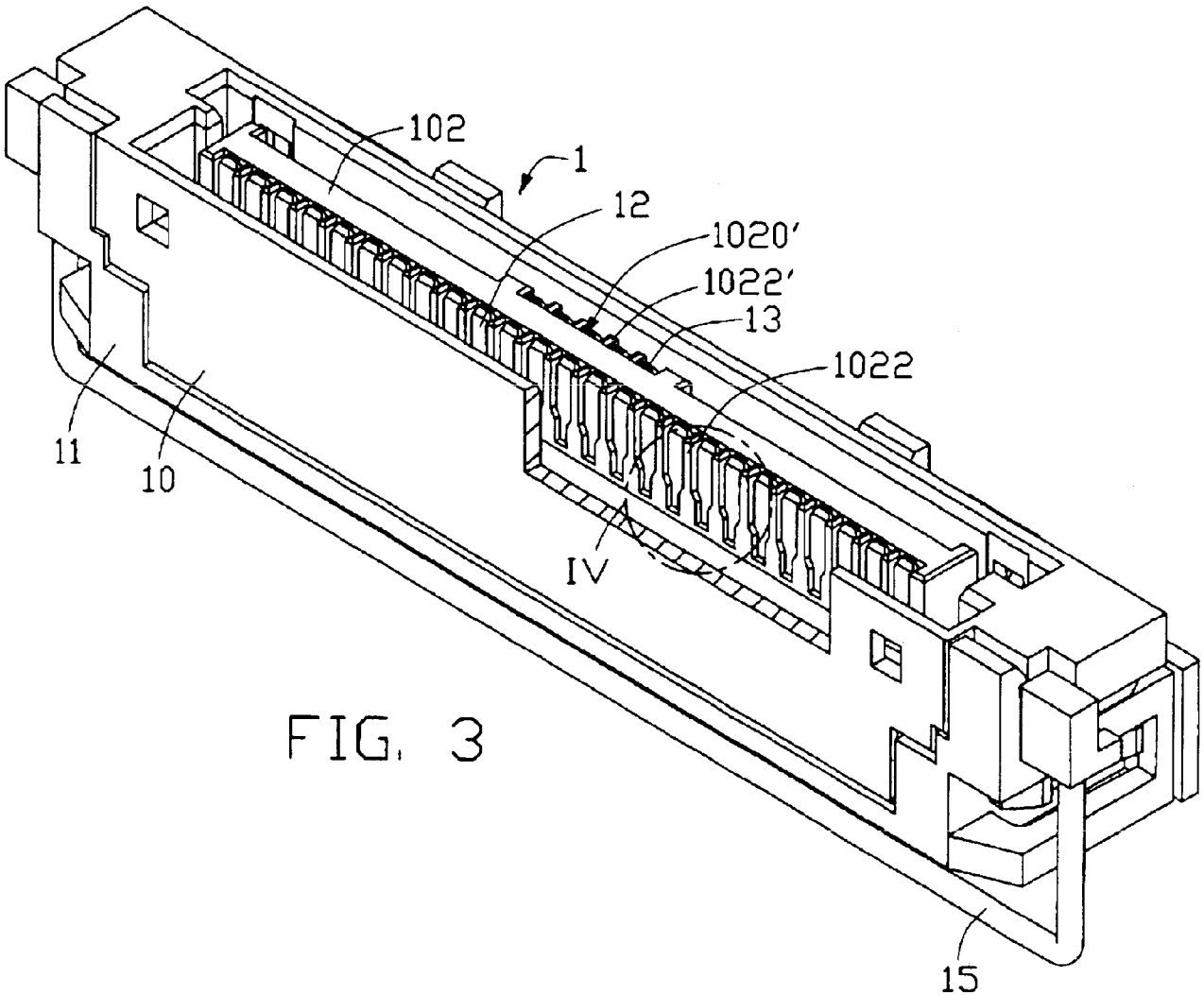
FIG. 3 is an assembled view of FIG. 1, with part of the first housing cut away.
Figure 4:
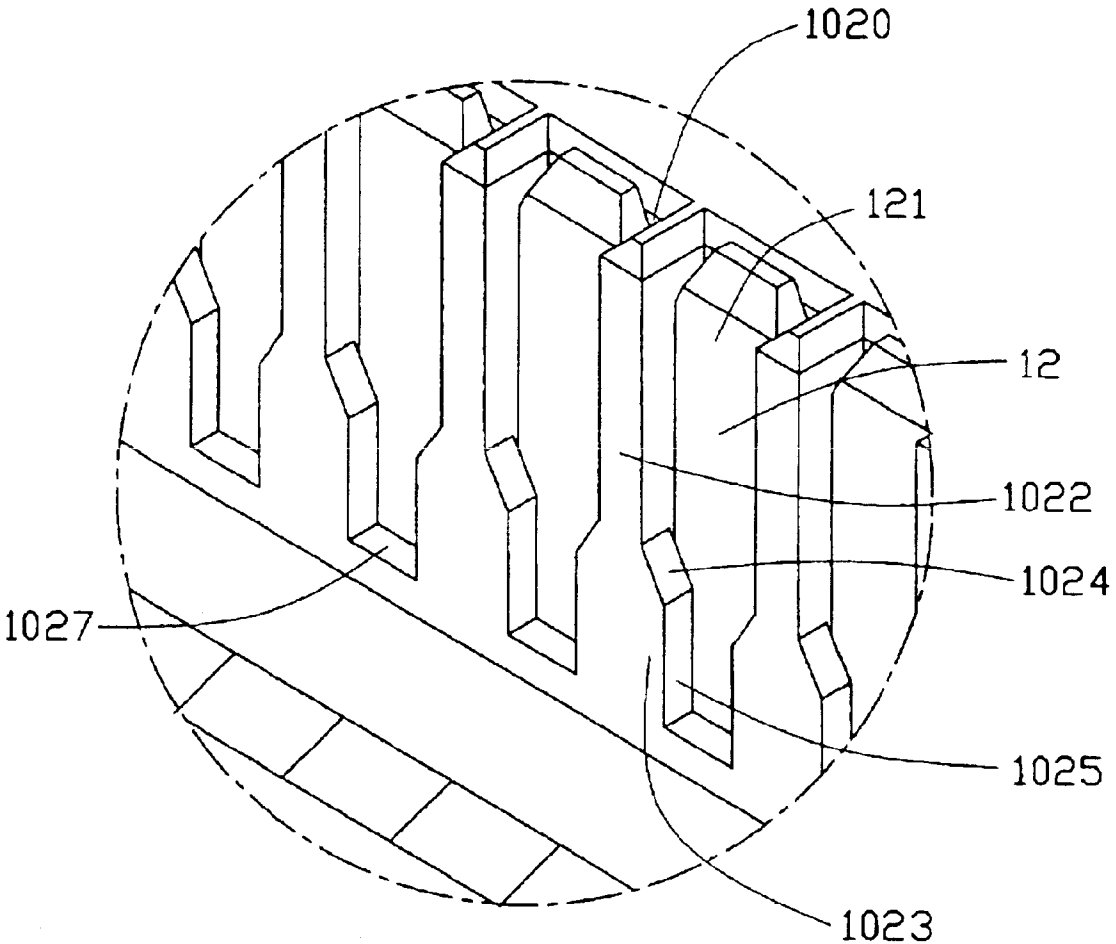
FIG. 4 is an enlarged view of a circled portion IV of FIG. 3.

Referring to FIGS. 3 and 4, a plurality of first spacers 1022 is formed on one longitudinal side surface 1020 of the island 102. A plurality of second spacers 1022' is formed on a middle part of an opposite longitudinal side surface 1020' of the island 102. Each two adjacent first spacers 1022 and the side surface 1020 cooperatively define a first terminal-passage 1021, for receiving a corresponding first terminal 12. Each two adjacent second spacers 1022' and the side surface 1020' cooperatively define a second terminal-passage 1026, for receiving a corresponding second terminal 13.

Two retention portions 1023 extend perpendicularly in opposite directions from opposite sides of each first spacer 1022, the retention portions 1023 being in a same plane and parallel to the side surface 1020 of the island 102. Each retention portion 1023 has a lower vertical positioning surface 1025 and an upper slanted guiding surface 1024. Respective bottoms of two opposing retention portions 1023 of each two adjacent first spacers 1022 are connected by a connecting portion 1027 therebetween. Two opposing guiding surfaces 1024 of each two adjacent first spacers 1022 cooperatively facilitate insertion of a corresponding mating contact of a complementary electrical connector (not shown), until said mating contact is received between the two opposing positioning surfaces 1025 of the two adjacent first spacers 1022. Each second spacer 1022' has substantially the same configuration as each first spacer 1022.

Referring back to FIG. 1, the second housing 11 defines an elongate second opening 110 therein. A plurality of first terminal-slots 1100 is defined in the second housing 11 at the second opening 110, corresponding to the first terminal-passages 1021. The first terminal-slots 1100 are for receiving corresponding first terminals 12 therein. A plurality of second terminal-slots 1101 is defined in one side wall of the second housing 11 at the second opening 110, corresponding to the second terminal-passages 1026. The second terminal-slots 1101 are for receiving corresponding second terminals 13 therein. A pair of spaced first hooks 111 is formed on one longitudinal side portion of a top of the second housing 11, corresponding to the protruding blocks 1001 of the first housing 10. A pair of spaced second hooks 112 is formed on an opposite longitudinal side portion of the top of the second housing 11, corresponding to the protrusion portions 1012 of the first housing 10. A pair of female cantilever engaging portions 113 is formed at opposite ends of the second housing 11 respectively.

Each first terminal 12 includes a first engaging portion 121, and a first mating portion 120. The first engaging portion 121 engages with a corresponding mating contact of the complementary electrical connector. The first mating portion 120 engages with a corresponding conductive member of an FPC board (not shown). Each second terminal 13 has a configuration similar to that of each first terminal 12. Each second terminal 13 includes a second engaging portion 131 and a second mating portion 130. The second engaging portion 131 engages with a corresponding mating contact of the complementary electrical connector. The second mating portion 130 engages with a corresponding conductive member of the FPC board. Thus electrical engagement between the complementary electrical connector and the FPC board is attained.

The slider member 14 has an elongate configuration, and is slidably inserted into the second housing 11. A pair of elastic male cantilever engaging portions 141 is formed at opposite ends of the slider member 14 respectively, corresponding to the female engaging portions 113 of the second housing 11. An elongate pressing portion 140 is formed on the slider member 14 between the male engaging portions 141.

The actuator member 15 is pivotally attached to the first housing 10, and includes an actuator cross beam 150. A pair of aligned pivot shafts 151 is formed at opposite ends of the cross beam 150 respectively, for engaging in the corresponding pivot holes 1011 of the first housing 10.

Figure 5:
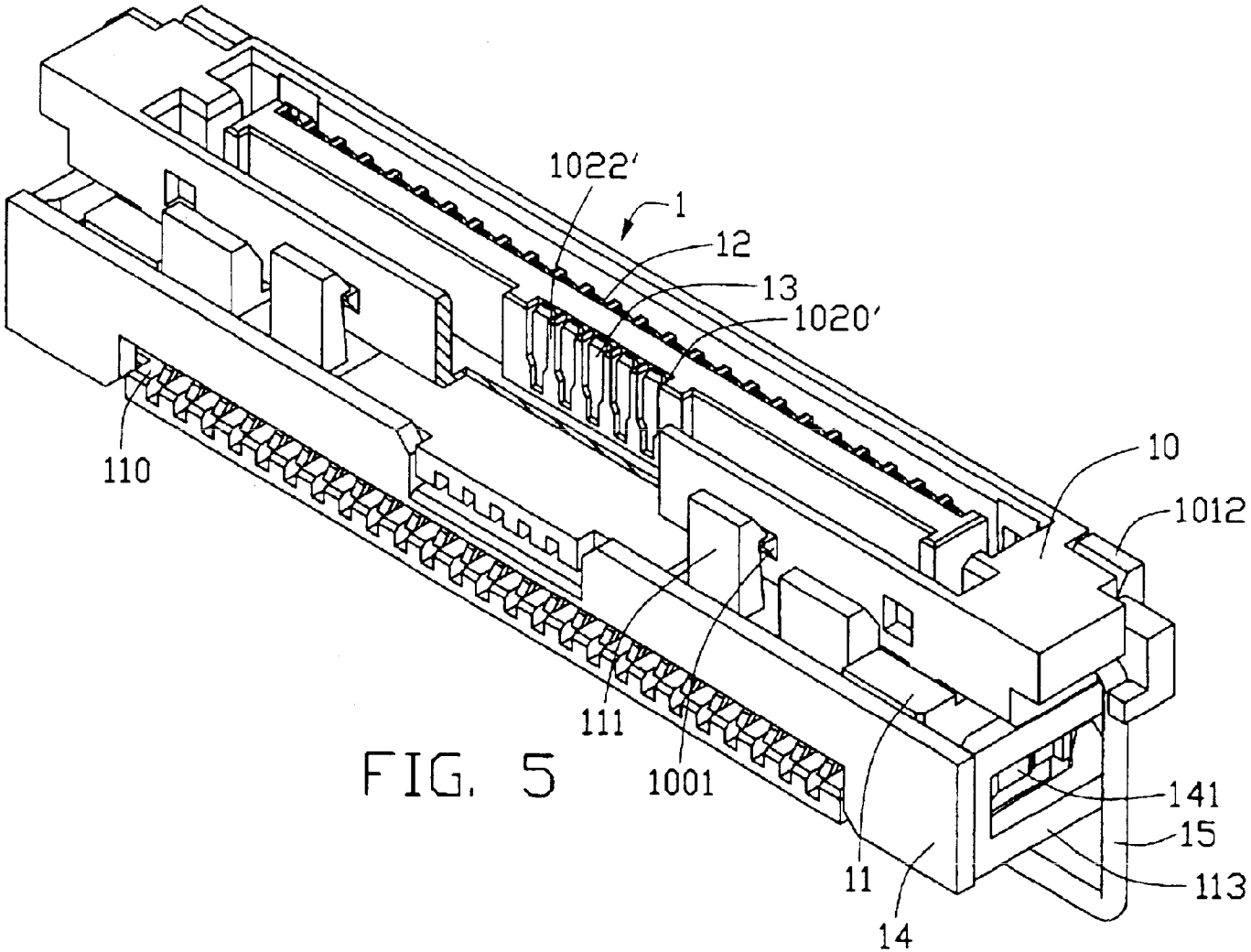
FIG. 5 is similar to FIG. 3, but viewed from another aspect and with another part of the first housing cut away.
Figure 6:
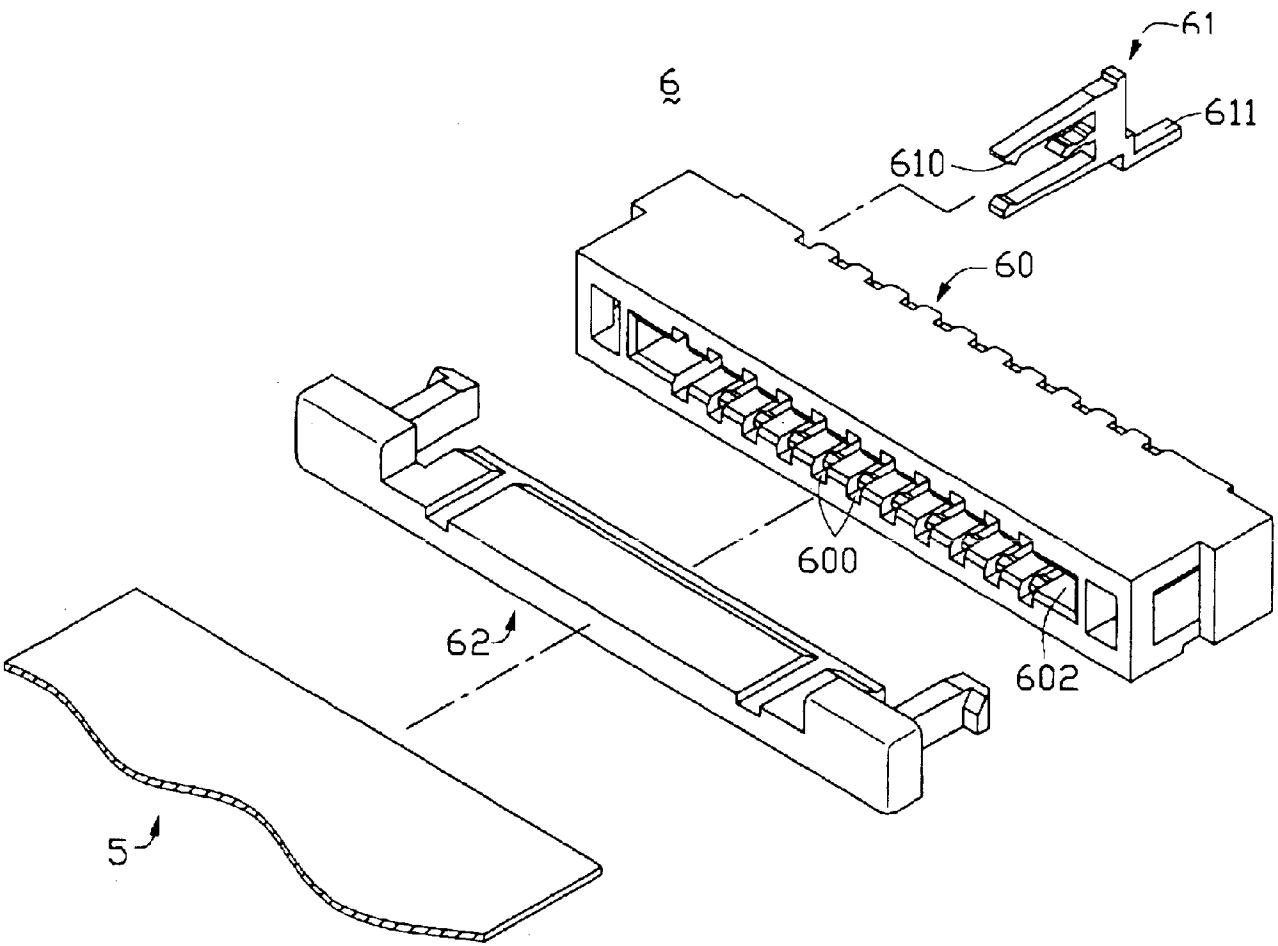
FIG. 6 (PRIOR ART)
FIG. 6 is an exploded, isometric view of a conventional FPC connector, together with part of an FPC board.
Figure 7:
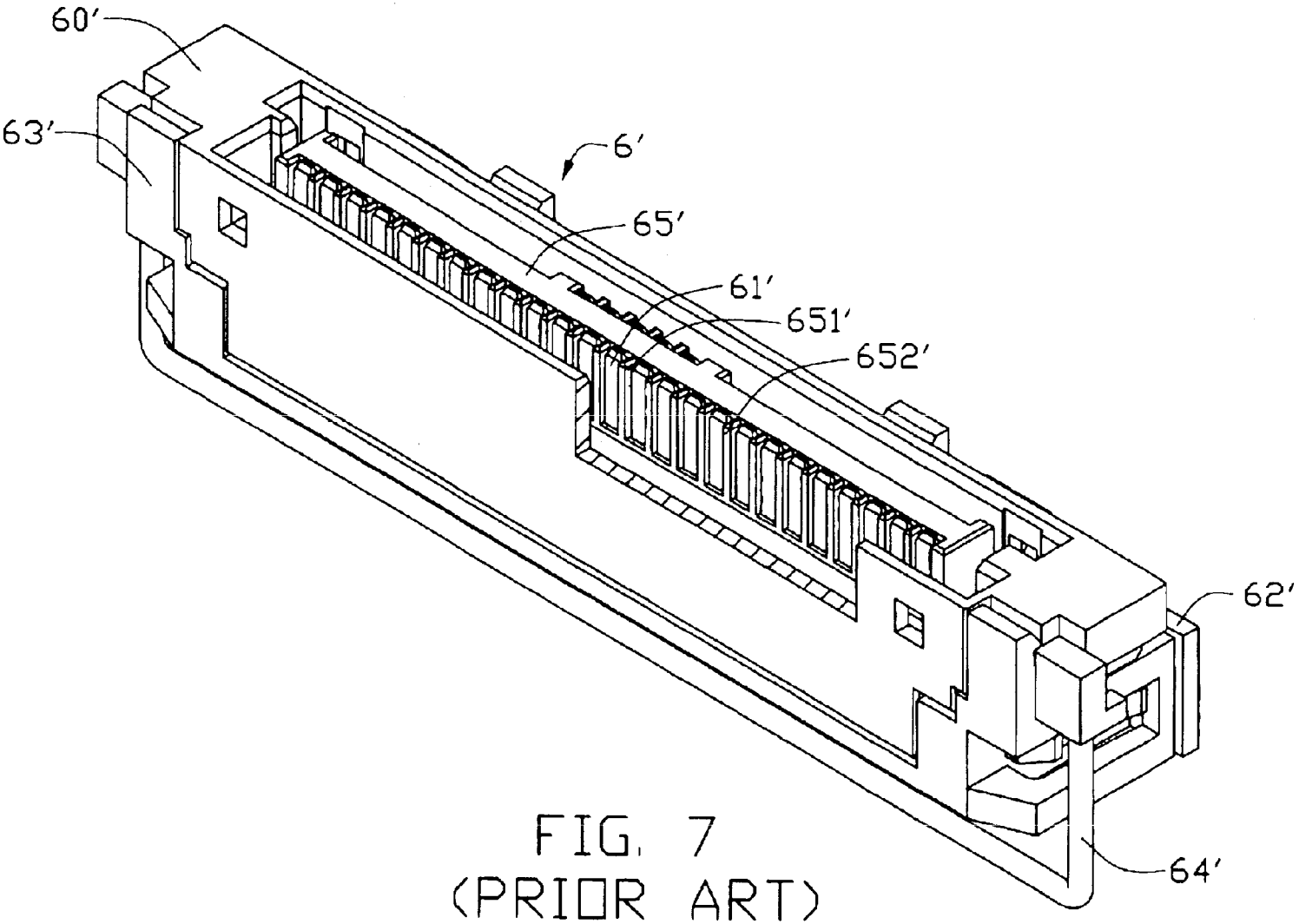
FIG. 7 (PRIOR ART)
FIG. 7 is an isometric view of a conventional FPC adaptor connector, with part of a housing thereof cut away.

Referring to FIGS. 1 and 5, in assembly, the mating portions 120, 130 of the terminals 12, 13 are inserted in the corresponding first and second terminal-slots 1100, 1101 of the second housing 11 via a front surface of the second housing 11.

The pivot shafts 151 of the actuator member 15 are received in the corresponding pivot holes 1011, thereby pivotally attaching the actuator member 15 to the first housing 10. The first housing 10 is then mounted on the second housing 11, with the first and second hooks 111, 112 of the second housing 11 respectively snappingly engaging with the protrusion blocks 1001 and the protrusion portions 1012 of the first housing 10. Simultaneously, the first and second engaging portions 121, 131 of the first and second terminals 12, 13 are received in the corresponding first and second terminal-passages 1021, 1026 of the first housing 10.

During insertion of the first engaging portions 121 of the first terminals 12 into the first housing 10, the two opposing retention portions 1023 at each first terminal-passage 1021 prevent the first engaging portion 121 of the corresponding terminal 12 from deflecting away from the side surface 1020 of the island 102. Similarly, during insertion of the second terminals 13 into the first housing 10, the configurations of the second spacers 1022' prevent the second engaging portions 131 of the terminals 13 from deflecting away from the side surface 1020' of the island 102.

In use, the mating contacts of the complementary electrical connector are inserted into the corresponding first and second terminal-passages 1021, 1026. Said mating contacts engage with mating surfaces of the first and second engaging portions 121, 131 of the corresponding first and second terminals 12, 13, with the first and second engaging portions 121, 131 being pushed against the corresponding side surfaces 1020, 1020' of the island 102. Thus bottommost ends of said mating contacts do not press against topmost ends of the first and second engaging portions 121, 131. As a result, damage to said mating contacts and the first and second terminals 12, 13 is avoided.

Additionally, the two opposing guiding surfaces 1024 at each first terminal-passage 1021 guide insertion of a corresponding mating contact of the complementary electrical connector until said mating contact is received between the two opposing positioning surfaces 1025 at the first terminal-passage 1021. Thus said mating contact and the corresponding terminal 12 are securely mated in the correct position. Similarly, the configurations of the second spacers 1022' provide secure mating of mating contacts of the complementary electrical connector with the corresponding terminals 13. Thus reliable mechanical and electrical engagement between said mating contacts and the corresponding terminals 12, 13 is attained, even if said mating contacts are not precisely positioned in the complementary electrical connector itself.

The above-described embodiment shows the first spacers 1022 each having two retention portions 1023 at opposite sides thereof respectively. It should be understood that the first spacers 1022 may have other alternative configurations. For example, the first spacers 1022 each may have only one retention portion 1023 at one side thereof. Similarly, the second spacers 1022' each may have only one retention portion at one side thereof.

Further, although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

a dielectric housing defining a side surface, the side surface forming a plurality of spacer members, two adjacent spacer members and the side surface cooperatively defining a terminal-passage; and a plurality of terminals each received in a corresponding terminal-passage;

wherein the spacer members each form at least one retention portion at one side thereof so as to stop movement of a corresponding terminal in the corresponding terminal-passage between the side surface and the at least one retention portion;

wherein the terminals each have a mating portion and an engaging portion;

wherein the spacers each form two retention portions at opposite sides thereof;

wherein the retention portions each are configured with a slanted guiding surface and a positioning surface;

wherein two adjacent opposing retention portions of the terminal-passage have a common connecting portion;

wherein the housing is elongate and defines a first opening and an elongate island in the first opening;

wherein the side surface is formed on the island;

wherein the housing defines protrusions and pivot holes at longitudinal opposite ends thereof and blocks at one of the longitudinal opposite sides thereof;

comprising a dielectric second housing;

wherein the second housing is elongate, and defines a plurality of terminal-slots corresponding to the terminal-passages of the housing;

wherein the second housing defines first and second hooks corresponding to the blocks and the protrusions of the housing respectively;

wherein the second housing defines a pair of female engaging portions at opposite ends thereof;

a slider member, the slider member comprising a pair of male engaging portions at opposite ends thereof and a pressing portion between the male engaging portions;

an actuator mechanism, the actuator mechanism comprising an actuator lever, and two pivot shafts corresponding to the pivot holes of the housing.

2. An electrical connector comprising:

a first insulative housing defining a first mating port exposed to an exterior in a vertical direction, the first housing latchably stacked upon a second housing which defines a second mating port exposed to the exterior in a horizontal direction;

an elongated side wall extending downwardly from the first housing and covering a back portion of the second mating port;

first and second groups of terminals each disposed in both said first housing and said second housing, the first group of terminals aligned with one another in a lengthwise direction perpendicular to both said vertical direction and said horizontal direction, with a first vertical mating portion positioned farther away from said side wall and with a first horizontal mating portion located on an upper portion of the second mating port, the second group of terminals aligned with one another in said lengthwise direction, with a second vertical mating portion positioned closer to the side wall and with a second horizontal mating portion located on a lower portion of the second mating port;

wherein a slider member latchably insertable into the second mating port toward said side wall;

wherein said second housing defines a plurality of terminal slots in an upper portion thereof to receive the corresponding first group of terminals therein.

* * * * *